United States Patent [19]

Kositzke

[11] Patent Number: 4,995,429

[45] Date of Patent: Feb. 26, 1991

[54] PAPER MACHINE FABRIC

[75] Inventor: Robert H. Kositzke, Appleton, Wis.

[73] Assignee: Albany International Corp., Menands, N.Y.

[21] Appl. No.: 826,308

[22] Filed: Feb. 5, 1986

[51] Int. Cl.[5] ..... D03D 11/00; D03D 15/00

[52] U.S. Cl. ..... 139/383 R; 139/383 R; 139/410; 139/420 A; 162/DIG. 1

[58] Field of Search ..... 139/383 A, 383 R, 410, 139/420 A; 162/DIG. 1

[56] References Cited

U.S. PATENT DOCUMENTS

| | | | |
|---|---|---|---|
| 3,885,602 | 5/1975 | Slaughter | 162/DIG. 1 |
| 3,885,603 | 5/1975 | Slaughter | 162/DIG. 1 |
| 4,071,050 | 1/1978 | Codorniu | 139/383 A |
| 4,408,637 | 10/1983 | Korm | 162/DIG. 1 |
| 4,461,803 | 7/1984 | Booth et al. | 162/DIG. 1 |
| 4,499,927 | 2/1985 | Borel | 162/DIG. 1 |
| 4,501,303 | 2/1985 | Osterberg | 139/383 A |
| 4,554,953 | 11/1985 | Borel et al. | 162/DIG. 1 |
| 4,564,051 | 1/1986 | Odenthal | 139/383 A |
| 4,569,375 | 2/1986 | Borel | 139/383 A |
| 4,592,396 | 6/1986 | Borel et al. | 162/DIG. 1 |

FOREIGN PATENT DOCUMENTS 0114656 8/1984 European Pat. Off. .

*Primary Examiner*—James C. Cannon

*Attorney, Agent, or Firm*—Kane, Dalsimer, Sullivan, Kurucz, Levy, Eisele & Richard

[57] ABSTRACT

A multilayer papermaking machine fabric is disclosed, characterized in part by alignment vertically of yarns in each layer.

8 Claims, 1 Drawing Sheet

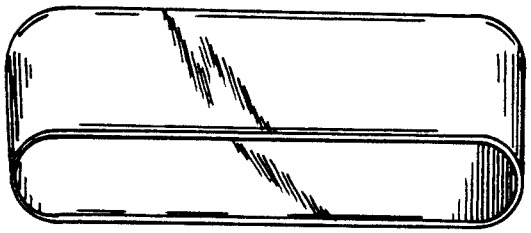
FIG.1
FIG.2
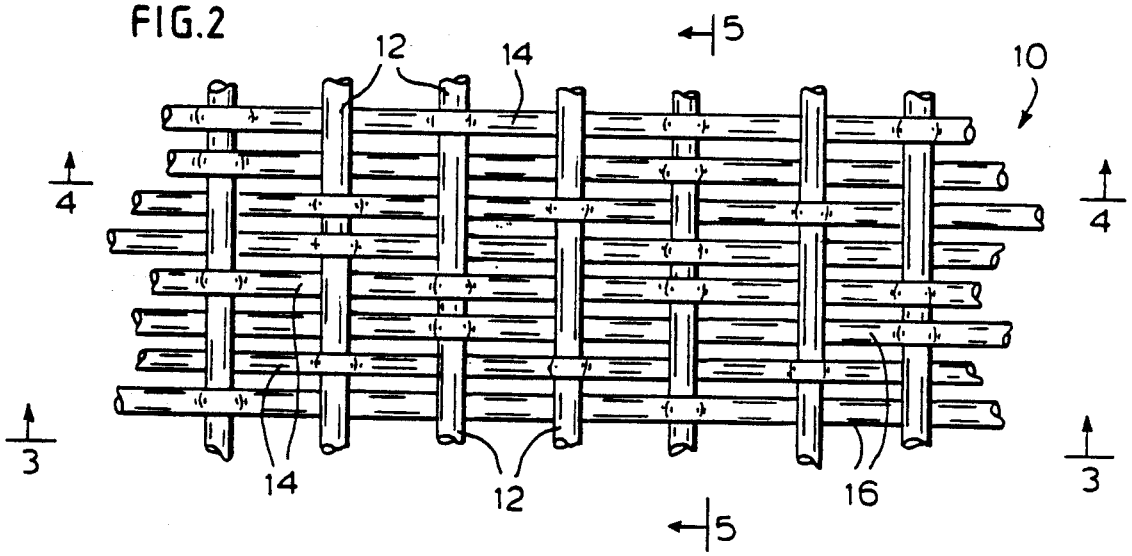
FIG.3
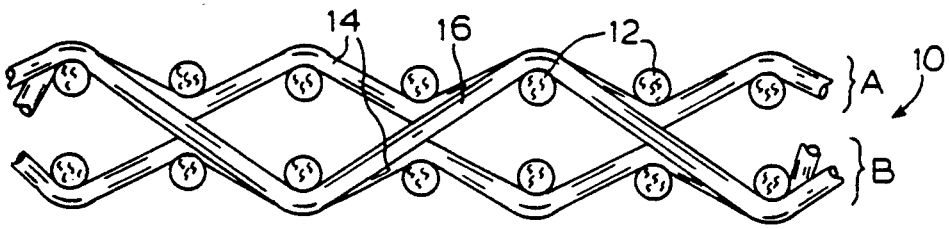
FIG.4
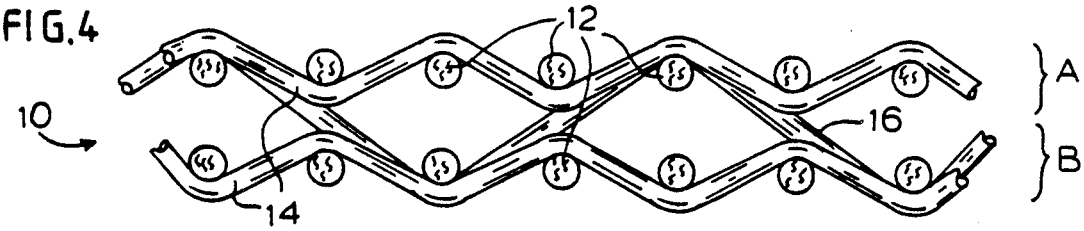
FIG.5
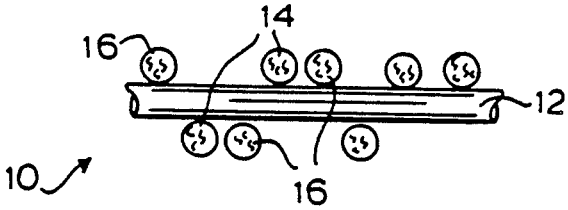

PAPER MACHINE FABRIC

BACKGROUND OF INVENTION

1. Field of the Invention

The invention relates to paper machine clothing useful for fabrication of belts, employed in the paper making machine.

2. Brief Description of the Prior Art

Papermaking machines are well known in the art. The modern papermaking machine is in essence a device for removing water from the paper furnish. The water is removed sequentially in three stages or sections of the machine. In the first or forming section, the furnish is deposited on a moving forming wire and water drained through the wire to leave a paper sheet or web. The formed web is then carried into a wet press felt section and passed through one or more nip presses on a moving press felt to remove water to form a sheet having a higher solids content. This sheet is transferred to the dryer section of the papermaking machine where dryer felts press the paper sheet to hot steam heated cylinders to further increase the solids content.

On papermaking machines, endless belts are employed in the various sections to carry the sheet or web of paper. There are a wide variety of forms of the endless belts, some fabricated from metal and others from textile material such as cotton, cotton and asbestos, or cotton, asbestos and synthetic fibrous or filamentous materials. The selection of a given material is dependent to some degree upon the use to which the fabric will be put; i.e., as a forming fabric dryer felt, etc. The openness of the belt is dependent upon the internal fabric interstices or voids between lengthwise and cross-wise yarns in the fabric The greater the volume of interstices or voids, the more distant are the yarns from each other. The greater the openness then, the more potential for a lowering of structural integrity and dimensional stability in the screen.

In carrying the formed paper web through the papermaking machine, the belt aids in drying, controls shrinkage of the paper web and prevents cockles. The fabric must possess strength, dimensional stability, resistance to chemical and thermal degradation, resistance to abrasion, and have a functional permeability. In recent years all monofilament structured fabrics have been developed to meet the above-described needs. However, felts fabricated from all monofilament fabrics have heretofore not been entirely satisfactory. Single-layer all monofilament fabrics generally lack the high degree of dimensional stability required for long use. Multilayered all-monofilament fabrics are characterized in part by improved dimensional stability (in comparison to single-layer fabrics), but the higher yarn density results in less openness and air permeability, which is important to efficiency.

The fabric of the present invention is characterized, in part, by a high percentage of open area (30 to about 55 percent). This is novel for a multilayer fabric. The fabric of the invention also possesses the dimensional stability associated with a multilayer fabric.

Although the subject invention is described with reference to its use in particular sections and postions in a papermaking machine, it has use in all positions and sections of papermaking machinery where a fabric of its characteristics is desirable.

It should further be noted that the fabric of this invention can be used as a base fabric in a needled structure and/or one which is further treated and processed.

SUMMARY OF THE INVENTION

The invention comprises a papermaking machine fabric, which comprises:

an upper layer of interwoven first machine direction and first cross-machine direction yarns, said first yarns being of a synthetic, polymeric resin;

a lower layer of interwoven second machine direction and second cross-machine direction yarns, said second yarns being of a synthetic, polymeric resin;

the first machine direction yarns of the upper layer being in vertical alignment with the corresponding underlying second machine direction yarns of the lower layer and/or the first cross-machine direction yarns of the upper layer being in vertical alignment with the corresponding underlying second cross-machine direction yarns of the lower layer; and machine direction and/or cross-machine direction yarns interwoven with the respective cross-machine direction or machine direction yarns in the upper and the lower layers at positions between the vertically aligned first and second cross-machine direction yarns of the upper and the lower layers.

The fabric of the invention may be made endless by joining the ends with a pin seam. The endless belt of the fabric, when installed on a paperworker's machine and dryer felt, performs well and is dimensionally stable.

The invention also comprises wet press felt fabrics and forming fabrics wherein the machine direction yarns of an upper layer are in vertical alignment with the machine direction yarns of a lower layer and/or the cross-machine direction yarns of an upper layer are in vertical alignment with the cross-machine direction yarns of a lower layer.

BRIEF DESCRIPTION OF THE DRAWINGS

FIG. 1 is a view-in-perspective of an embodiment dryer belt of the invention.

FIG. 2 is a top view, enlarged, of the fabric making up the belt of FIG. 1.

FIG. 3 is a cross-sectional view along lines 3—3 of FIG. 2.

FIG. 4 is a view along lines 4—4 of FIG. 2

FIG. 5 is a view along lines 5—5 of FIG. 2.

DETAILED DESCRIPTION OF THE PREFERRED EMBODIMENTS OF THE INVENTION

A complete understanding of the invention may be readily obtained from the following description of the preferred embodiments, read in conjunction with the accompanying drawings of FIGS. 1–4, inclusive.

FIG. 1 is a view-in-perspective of an embodiment (endless) belt 8 of the invention, made by seaming together in conventional manner the ends of a fabric of the invention.

FIG. 2 is a top view, enlarged, of a portion of the upper layer of the fabric 10 of the invention, making up the belt 8 shown in FIG. 1. The upper layer of the fabric 10 is made up by an interweaving of machine direction (warp) yarns 12 with a plurality of cross-machine direction (weft) yarns 14. The yarns 12, 14 may be any of the textile yarns used in papermakers fabrics and as shown in FIG. 2 are monofilaments and may be extruded monofilaments of any known synthetic, polymeric resin in any conventional denier. Representative of the preferred monofilament yarns 12, 14 are monofilament yarns of polyesters, polyamides, polyaramids, polyolefins and the like which do not absorb high proportions of moisture. The machine direction yarns 12 and the cross-machine direction yarns 14 are preferably monofilaments with an average diameter of from about 0.008 to 0.04 inches to provide a high degree of stability and structural integrity in the fabric of the invention. The lower layer of the fabric 10 may be identical in construction to the upper layer; i.e., interwoven yarns 12, 14 in a simple weave as described above For each yarn 12, 14 in the upper layer there is a corresponding yarn 12, 14 in the underlying layer. Each yarn 12, 14 of the upper layer is stacked in vertical alignment with the corresponding yarn 12, 14 of the underlying layer. It is not necessary that both yarns 12, 14 be in vertical alignment with the underlying and corresponding lower yarns 12, 14. For example, only the yarns 12 or the yarns 14 need be so arrayed.

FIG. 3 is a view along lines 3—3 of FIG. 2 and shows in a cross-sectional side elevation that the fabric 10 comprises a plurality of crosswise yarns 14 disposed in an upper layer A and in a lower layer B. In each layer A, B the cross-machine direction yarns 14 interweave with the separate machine direction yarns 12. The layers A, B are parallel to the machine direction plane of the fabric 10. The layers A and B are bound together by the interwoven cross-machine direction 16 yarns. The binder 16 yarns may be monofilament, multi-filament or spun yarns of any conventional denier. Preferably low absorption monofilament yarns are employed. Representative of preferred monofilament binder 16 yarns are monofilament yarns of polyesters, polyamides, polyaramids, polyolefins and the like which do not absorb high proportions of moisture. Preferably the monofilaments will have a diameter of from about 0.008 to 0.04 inches to provide a high degree of stability and structural integrity in the fabric of the invention, and preferably are equal to or smaller in diameter than the cross-machine yarns 14. Alternatively, machine direction yarns may be used as binder yarns.

It will be observed from FIG. 3 that there is a plurality of interstices or voids among the layers A, B separating crosswise yarns 14 in the layer A from the crosswise yarns 14 in layer B, cross-machine 14 within the layers A,B from each other and machine direction yarns 12 from each other as well. These voids are open areas within the body of fabric 10 which permit unimpeded flow of air through the fabric 10, accounting in part for the high permeability associated with these screen types of fabric.

The FIGS. 4 and 5, which are views along lines 4—4 and 5—5, respectively, of FIG. 2, also show in detail the vertical alignment of the machine direction yarns 12 in layer A with the machine direction yarns 12 of layer B and of the cross-machine direction yarns 14 of the layer A with the cross-machine direction yarns 14 of layer B. This vertical stacking of the yarns in layer A with corresponding yarns in layer B minimizes impedence of air flow through the fabric 10 voids; i.e., maintains maximum openness. The occasional dipping of alternate binder yarns 16 between adjacent yarns 12 in each layer opens the voids to the surfaces of the fabric 10 so that there is a continuous and open communication through the fabric 10 for the passage of air.

When there are more than two layers in the fabric of the invention, the yarns in the additional layers are also in vertical alignment with the overlying or underlying layers as described above.

The fabric 10 may be woven by conventional weaving techniques, well known to those skilled in the art. Thus, the fabric 10 may be woven on a conventional papermaker's felt loom in a single operation. The upper and lower layer A, B yarns 12, 14 are woven with the machine direction yarns 12 of layer A positioned directly over the corresponding machine direction yarns 12 of the lower layer B and the cross-machine direction yarns 14 of the upper layer A positioned directly above respective cross-machine direction yarns 14 in the lower layer B. The reed for the fabric 10 is designed to accommodate the top and bottom machine direction yarns 12 within the same openings, with minimal clearance for one yarn only. This reed design restricts movement of the machine direction yarns sideways and laterally, thereby forcing vertical stacking of the machine direction yarns 12. Similarly, stacking of the cross-machine direction yarns 14 in a vertical line is also established. The combining of the two layers A, B is obtained during the weaving process by sinking a cross-machine direction yarn 16 in the space between cross-machine direction yarns 14, to interlace with a machine direction yarn 12 in the lower layer B to provide stitching points. The combining of the layers A, B is preferably in a set sequence; for example, between alternate yarns 12, so as not to distort either of the layers A, B.

The density of the yarns 12, 14, 16 will depend upon the size of the yarns selected and may advantageously range from between 10 to 180 machine direction yarn ends to the inch and from 10 to 100 cross-machine direction yarn ends to the inch.

A number of the machine direction yarns 12 may be provided having loops at the fabric 10 end. The loops may be formed by conventional techniques and provide a means of forming a joinder and seam between the free ends of the fabric 10. Alternatively, the ends of the fabric 10 may be frayed to break the ends and monofilament loops hand-woven back to provide a seam structure A whole seam; i.e., circa at least about 448 ends, is preferred to obtain adequate distortion and tensile strength values.

Those skilled in the art will appreciate that many modifications of the preferred embodiments described above may be made without departing from the spirit and the scope of the invention. For example, the fabric of the invention may be woven to include various stuffer picks, to obtain fabrics of different permeabilities as will be appreciated by those skilled in the art.

The felts of the invention may also be finished in any conventional manner; i.e., for example chemical treatments to offer specific properties of runability and resistance to chemical and abrasive degradation and may be utilized as base fabrics in other constructions.

Following the manufacture of the fabrics of the invention, the fabrics may be heat-set to stabilize the fabric and to draw the yarns into desired relative positions. The degree of heat-setting required to achieve the desired structure of the fabric will of course vary depending on the polymer nature of the yarns. However, optimum times, temperatures and tensions placed on the fabric during heat-setting can be determined by those skilled in the art, employing trial and error technique for the different yarn materials. In general, heatsetting may be carried out at temperatures of from about 150° F. to 400° F. for from 15 to 60 minutes.

The following example describes the manner and the process of making and using the invention and set forth the best mode contemplated by the inventor of carrying out the invention, but is not to be construed as limiting.

EXAMPLE 1

There is provided a quantity of 0.016 inch diameter polyester monofilaments which are woven in a duplex pattern; i.e., a multiple system of weft and a single system of warp. The cross-machine direction (weft) yarns of the upper layer are placed on the loom in vertical alignment with the weft yarns of the lower layer.

The density of the monofilament machine direction (warp) yarns in the product is 80 ends to the inch. The number of cross-machine direction (weft) yarns in the product is 29.5 monofilaments and 14.5 binder yarns, for a total of 44 wefts per inch. The reed of the loom accommodates the top layer and the bottom layer machine direction (warp) yarns in a single opening.

The fabric of the Example is finished in a conventional manner; i.e., by heat-setting under tension to offer specific properties of runability.

The fabric is of a character useful for making endless and employing as a belt on a papermaking machine.

What is claimed is:

1. A papermaking machine fabric, which comprises:
an upper layer of interwoven first machine direction and first cross-machine direction yarns, said first yarns being of a synthetic, polymeric resin;
a lower layer of interwoven second machine direction and second cross-machine direction yarns, said second yarns being of a synthetic, polymeric resin;
the first machine direction yarns of the upper layer being in vertical alignment with the corresponding underlying second machine direction yarns of the lower layer; and/or
the first cross-machine direction yarns of the upper layer being in vertical alignment with the corresponding underlying second cross-machine direction yarns of the lower layer; and
one of cross-machine direction binder yarns interwoven with the machine direction yarns in the upper and the lower layers at positions between the vertically aligned first and second machine direction yarns of the upper and the lower layers : said dryer fabric having a projected open area of at last about 30–55% of the total area of the fabric.

2. The fabric of claim 1 wherein the cross-machine direction and machine direction yarns are monofilaments.

3. A papermaking machine fabric, which comprises:
a plurality of cross-machine direction yarns disposed in a plurality of separate layers, each layer being on a plane parallel to the cross-machine direction plane of the fabric;
a plurality of machine direction yarns interwoven with the cross-machine direction yarns and binding the layers of cross-machine direction yarns together to form a multi-layer textile fabric;
the cross-machine direction and machine direction yarns being synthetic monofilaments and the cross-machine direction yarns in a given layer being separated from adjacent cross-machine direction yarns in the adjacent layer by void spaces within the body of the woven fabric;
the first machine direction yarns of the upper layer being in vertical alignment with the corresponding underlying second machine direction yarns of the lower layer;
the first cross-machine direction yarns of the upper layer being in vertical alignment with the corresponding underlying second cross-machine direction yarns of the lower layer; and
cross-machine direction binder yarns interwoven with the machine direction yarns in the upper and the lower layers at positions between the vertically aligned first and second machine direction yarns of the upper and the lower layers;
said dryer fabric having a projected open area of at least about 30 to 55 percent of the total area of the fabric.

4. The fabric of claim 3 which further comprises:
a plurality of stuffer yarns running substantially parallel to the cross-machine direction yarns, between layers of cross-machine direction yarns and partially filling a portion of the void spaces between the layers of cross-machine direction yarns.

5. A papermaking machine fabric, which comprises:
an upper layer of interwoven first machine direction and first cross-machine direction yarns, said first yarns being of a synthetic, polymeric resin;
a lower layer of interwoven second machine direction and second cross-machine direction yarns, said second yarns being of a synthetic, polymeric resin;
the first machine direction yarns of the upper layer being in vertical alignment with the corresponding underlying second machine direction yarns of the lower layer; and/or
the first cross-machine direction yarns of the upper layer being in vertical alignment with the corresponding underlying second cross-machine direction yarns of the lower layer; and
one of machine direction binder yarns interwoven with the cross-machine direction yarns in the upper and the lower layers at positions between the vertically aligned first and second machine direction yarns of the upper and the lower layers: said dryer fabric having a projected open area of at least about 30–55% of the total area of the fabric.

6. The fabric of claim 5 wherein the cross-machine direction and machine direction yarns are monofilaments.

7. A papermaking machine fabric, which comprises:
a plurality of cross-machine direction yarns disposed in a plurality of separate layers, each layer being on a plane parallel to the cross-machine direction plane of the fabric;
a plurality of machine direction yarns interwoven with the cross-machine direction yarns and binding the layers of cross-machine direction yarns together to form a multi-layer textile fabric;
the cross-machine direction and machine direction yarns being synthetic monofilaments and the cross-machine direction yarns in a given layer being separated from adjacent cross-machine direction yarns in the adjacent layer by void spaces within the body of the woven fabric;
the first machine direction yarns of the upper layer being in vertical alignment with the corresponding underlying second machine direction yarns of the lower layer;
the first cross-machine direction yarns of the upper layer being in vertical alignment with the corresponding underlying second cross-machine direction yarns of the lower layer; and machine direction binder yarns interwoven with the cross-machine direction yarns in the upper and the lower layers at positions between the vertically aligned first and second machine direction yarns of the upper and the lower layers;

said dryer fabric having a projected open area of at least about 30 to 55 percent of the total area of the fabric.

8. The fabric of claim 7 which further comprises:

a plurality of stuffer yarns running substantially parallel to the cross-machine direction yarns, between layers of cross-machine direction yarns and partially filling a portion of the void spaces between the layers of cross-machine direction yarns.

* * * * *